US006800995B2

(12) United States Patent
Ohnishi

(10) Patent No.: US 6,800,995 B2
(45) Date of Patent: Oct. 5, 2004

(54) IMAGE DISPLAY DEVICE

(75) Inventor: Tomoya Ohnishi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 96 days.

(21) Appl. No.: 10/301,583

(22) Filed: Nov. 22, 2002

(65) Prior Publication Data

US 2003/0102798 A1 Jun. 5, 2003

(30) Foreign Application Priority Data

Nov. 30, 2001 (JP) ..... 2001-366368
Nov. 11, 2002 (JP) ..... 2002-326821

(51) Int. Cl.[7] ..... H01J 31/12
(52) U.S. Cl. ..... 313/495; 313/308; 313/309; 313/497
(58) Field of Search ..... 315/169.3, 169.4; 313/467, 468, 495, 496, 497, 308, 309, 310, 422; 445/24

(56) References Cited

U.S. PATENT DOCUMENTS 5,821,685 A * 10/1998 Peterson ..... 313/309
6,169,358 B1 * 1/2001 Jones et al. ..... 313/495
6,486,610 B2 * 11/2002 Kojima et al. ..... 313/495
6,633,119 B1 * 10/2003 Chalamala et al. ..... 313/495
2002/0005692 A1 1/2002 Ando ..... 313/495
2002/0084997 A1 7/2002 Ohnishi ..... 345/211

FOREIGN PATENT DOCUMENTS

EP 1117124 A2 * 7/2001 ..... H01J/31/12
EP 1 117 124 A2 7/2001
JP P2001/250494 A 9/2001

* cited by examiner

*Primary Examiner*—Wilson Lee
(74) *Attorney, Agent, or Firm*—Fitzpatrick, Cella, Harper & Scinto

(57) ABSTRACT

An image display device is provided which is capable of increasing a dielectric voltage while reducing a depth and a frame region. The image display device is provided with a rear plate having surface conduction electron-emitting devices that are electron beam source and a faceplate having an anode electrode and a first potential regulating member on an identical surface. The anode electrode and the first potential regulating member are arranged separately from each other. The anode electrode is regulated to an electron accelerating potential. The first potential regulating member is regulated to a potential lower than that of the anode electrode. A second potential regulating member regulated to a potential lower than that of the anode electrode is provided at least in the vicinity of an end of the first potential regulating member on the anode electrode side on a surface on the opposite side of a surface having the first potential regulating member of the faceplate.

19 Claims, 12 Drawing Sheets

PARTIALLY ENLARGED
VIEW OF AREA A

IMAGE DISPLAY DEVICE

BACKGROUND OF THE INVENTION

1. Field of the Invention

The present invention relates to an image display device that utilizes electron beams such as a field emission display (FED).

2. Related Background Art

Up to now, image display devices such as a CRT (Cathode Ray Tube) have been required to be larger in size, and researches for this purpose have been actively conducted. In addition, as the image display devices have been required to be larger in size, it has become an important subject to make the devices thin, light-weight and low in costs. However, since a CRT deflects electrons accelerated with a high voltage by a deflection electrode to excite phosphors on a faceplate, when it is attempted to increase a size of the CRT, a larger depth is required in principle. Therefore, it is difficult to make the device thin and light-weight. Thus, as an image display device that can solve the above-mentioned problem, the inventors have been studying an image display device that uses surface conduction electron-emitting devices as electron beam sources.

The inventors have been attempting, for example, applications of a multi-electron beam source shown in FIG. 13. FIG. 13 is a perspective view showing a display panel of a conventional image display device with a part thereof cut away.

As shown in FIG. 13, the conventional multi-electron beam source is constituted by surface conduction electron-emitting devices 4001 that are wired in a passive matrix shape in areas surrounded by column direction wirings 4002 and row direction wirings 4003. In addition, FIG. 13 also shows a structure of a cathode ray tube using this multi-electron beam source. This structure consists of an outer container bottom (which may also be referred to as "rear plate") 4004 provided with the multi-electron beam source 4001, a sidewall (which may also be referred to as "support frame" or "outer container frame") 4005 and a faceplate 4006 provided with a phosphor layer 4007 and a metal back 4008. In addition, phosphors that are excited and caused to emit light by electron beams and a black matrix for controlling reflection of external light to prevent color mixing of the phosphors are provided in the phosphor layer 4007 on the faceplate 4006. In addition, a high voltage is applied to the phosphor layer 4007 and the metal back 4008 from a high voltage introducing terminal Hv. The phosphor layer 4007 and the metal back 4008 form an anode electrode.

The image display device as described above applies a high voltage (which may also be referred to as "acceleration voltage" or "anode voltage") to the metal back 4008 that is a part of the anode electrode, generates an electric field between the rear plate 4004 and the face plate 4006, accelerates electrons emitted from the electron beam sources 4001, and excites and causes the phosphors to emit light, thereby forming an image. Here, since a luminance of the image display device depends largely on an acceleration voltage, it is necessary to increase the acceleration voltage in order to realize a high luminance. In addition, in order to realize thinning of the image display device, a thickness of the image display panel should be reduced. For this purpose, a distance between the rear plate 4004 and the faceplate 4006 should be reduced. Consequently, a relatively high electric field is generated between the rear plate 4004 and the faceplate 4006.

However, the above-mentioned image display device has problems as described below.

FIG. 14 is a view schematically showing a section of the display panel of the image display device shown in FIG. 13. The above-mentioned image display device includes the rear plate 4004 having the electron beam sources 4001 and the faceplate 4006 provided with the anode electrode 4101 consisting of the metal back or a not-shown black matrix. An acceleration voltage Va is applied to the anode electrode 4101. Here, the anode electrode 4101 is insulated by a vacuum gap between the faceplate 4006 and the rear plate 4004 and creeping on surfaces of members such as the faceplate 4006 and the rear plate 4004.

A dimension of the vacuum gap regulates a depth of the display panel, and creeping distances of the faceplate 4006 and the rear plate 4004 regulate an area and a width of a region other than an image display region (which may be referred to as "frame region"). Both the depths of the display panel and the frame region are preferably smaller. However, when dimensions of them decrease, even if the same voltage is applied to the anode electrode 4101, a field intensity that is a value found by dividing the voltage by the distance increases. Thus, a probability of break down increases. When break down occurs, it is also likely that an image quality of the image display device is extremely deteriorated. This is a significant problem for improvement of reliability of the image display device.

In particular, the rear plate 4004 and the faceplate 4006 are generally formed of a glass member in many cases. Since a dielectric voltage of a dielectric body surface such as glass is extremely inferior to that of the vacuum air gap, it is very important to increase the dielectric voltage of a glass surface part.

FIG. 15 is a schematic sectional view of another conventional display panel described in EP1117124 (Japanese Patent Application Laid-Open No. 2001-250494).

As in the conventional another display panel shown in FIG. 15, a potential regulating electrode (which may also be referred to as "guard electrode") 5102, which is regulated to a potential lower than an anode potential, may be formed on the same member surface on which the anode electrode 5101 is formed for the purpose of regulating a potential distribution and limiting a region on which an electric field is applied on the surfaces of the rear plate 5004 and the faceplate 5006. This is because, if a structure is present in a region other than an image display region and an electric field is applied to that part, concentration of an electric field occurs depending on a shape of the structure, which leads to a possibility of causing break down. By forming the potential regulating electrode 5102 as described above and regulating it to a potential lower than an anode potential, it is possible to relax an electric field applied to the outside of the potential regulation electrode 5102.

Note that the structures of the electron beam source 5001, the row direction wiring and the column direction wiring (both of which are not shown) are the same as those in the display panel shown in FIG. 13.

However, with the structure having an electrode regulated to a potential lower than an anode potential on the same member surface as a region regulated to the anode potential as described above, an electric field on the outside of a potential regulating electrode (region receding away from an anode electrode) can be weakened. Thus, designing in the region on the outside of the potential regulating electrode becomes easy. However, on the other hand, if the distance between the potential regulating electrode 5102 and the anode electrode 5101 is reduced too much in order to reduce dimensions of regions other than the image display region, a field intensity between the anode electrode and the potential regulating electrode increases and break down occurs in that part.

SUMMARY OF THE INVENTION

Therefore, an object of the present invention is to provide an image display device in which a dielectric breakdown voltage is increased while reducing a depth and a frame region of the image display device.

In order to attain the above-mentioned object, according to the present invention, there is provided an image display device comprising:

a rear plate having an electron beam source; and a face plate having an anode electrode regulated to an electron accelerating potential and a first potential regulating member, which is arranged apart from the anode electrode and is regulated to a potential lower than that of the anode electrode, on a surface opposed to the rear plate, in which the image display device further comprises a second potential regulating member that is arranged in a part corresponding to the first potential regulating member side of an end of the anode electrode on the first potential regulating member side and on a surface on the opposite side of a surface having the first potential regulating member of the faceplate and that is regulated to a potential lower than that of the anode electrode.

According to the image display device of the present invention constituted as described above, since the electric field at the end of the first potential regulating member on the anode electrode side can be effectively weakened, it becomes possible to increase a dielectric breakdown voltage of the image display device. As a result, it becomes possible to reduce a depth and a frame region of the image display device.

This can be explained as described below. FIGS. 12A and 12B are sectional views showing a potential distribution inside a faceplate. Note that broken lines in the figures indicate equipotential lines.

In a faceplate 2006, if a potential of a surface on the opposite side of a surface on which an anode electrode 2101 and a first potential regulating member 2102 are provided is not regulated, a potential distribution as shown in FIG. 12A is obtained. Concentration of an electric field occurs at an end of the first potential regulating member 2102 on the anode electrode 2101 side that becomes a cathode side. On the other hand, if a second potential regulating member 2103 is provided on the faceplate 2006, a potential distribution as shown in FIG. 12B is obtained. An electric field at the end of the first potential regulating member 2102 on the anode electrode 2101 side that becomes a cathode side is weakened. When an electric field is concentrated at the end of the electrode on the cathode side, electrons are emitted by field emission, which leads to break down. Thus, since the electric field at the end of the electrode on the cathode side can be weakened by arranging the second potential regulating member 2103 as shown in FIG. 12B, it becomes possible to increase a dielectric voltage of the image display device.

Moreover, by constituting the image display device such that a resistance value of the first potential regulating member is larger than a resistance value of the anode electrode, even if a higher voltage is applied to the anode electrode or even if the anode electrode and the first potential regulating member are arranged more closely, it becomes possible to make operations of the image display device more stable.

This can be explained as described below.

There is a case in which a higher electric field is generated between the anode electrode and the first potential regulating member. For example, this is a case in which a higher voltage is applied to the anode electrode in order to realize a higher luminance of the image display device or the anode electrode and the first potential regulating member are arranged more closely in order to realize further miniaturization of the image display device. In such a case, it is likely that unexpected break down occurs between the anode electrode and the first potential regulating member. When this break down occurs, a shorted state occurs between the anode electrode and the first potential regulating member. Thus, a magnitude of an electric current flowing between the anode electrode and the first potential regulating member depends on resistance values of the anode electrode and the first potential regulating member. Here, if the resistance value of the first potential regulating member is larger than the resistance value of the anode electrode as in the present invention, a high voltage is substantially applied to the first potential regulating member. In other words, a potential at the end of the first potential regulating member on the anode electrode side is increased to an anode potential. Consequently, the break down between the anode electrode and the first potential regulating member ends. That is, since the resistance value of the first potential regulating member is larger than the resistance value of the anode electrode, the first potential regulating member functions as a current limiting resistance when break down (discharge) occurs. Then, when the discharge ends, the potential of the first potential regulating member returns to a normal state. If a higher electric field is thereafter generated between the anode electrode and the first potential regulating member, since the first potential regulating member acts in the same manner, the above-mentioned effects can be expected continuously.

In addition, the image display device may be constituted such that a resistance value of the first potential regulating member has a magnitude that is one-hundred times or more as large as a resistance value of the anode electrode.

Moreover, the image display device is preferably constituted such that the second potential regulating member is arranged so as to overlap an orthogonal projection of the first potential regulating member. More preferably, the image display device is constituted such that the second potential regulating member is arranged so as to overlap an orthogonal projection of at least a part of the first potential regulating member closest to the anode electrode. Alternatively, the image display device is preferably constituted such that the second potential regulating member is arranged so as to overlap an orthogonal projection of at least an external circumferential end of the anode electrode. By arranging the second potential regulating member in this way, it becomes possible to weaken an electric field at the end of the first potential regulating member on the anode electrode side.

In addition, by constituting the image display device such that the second potential regulating member is arranged over substantially the entire surface of the faceplate, it becomes possible to regulate a potential of a surface on the atmosphere side (observer side) of the faceplate over the entire region while weakening an electric field at the end of the first potential regulating member on the anode electrode side.

In this case, the second potential regulating member preferably consists of a transparent material. Here, "transparent" means that an average transmissivity of visible light is generally 30% or more.

Moreover, the image display device may be constituted such that a high resistance film is formed in the region between the first potential regulating member and the anode electrode. An insulating surface (surface of the faceplate) between the anode electrode and the first potential regulating member tends to be a source of discharge. This is because the insulating surface becomes a triple junction where a dielectric body such as glass that is a material of the faceplate, metal that is a material of the anode electrode and the first potential regulating member and a vacuum space formed between the faceplate and the rear plate are close to each other and an electric field concentrates, and the surface of the insulating surface is charged. In order to avoid such a situation, the high resistance film is provided on the insulating surface of the region between the first potential regulating member and the anode electrode as in the present invention, whereby it becomes possible to prevent concentration of an electric field and charging and make it less likely to cause break down.

Moreover, when a surface resistance value of the high resistance film is too low, power consumption increases, and when it is too high, the high resistance film is susceptible to influences of the concentration of an electric field and the charging. Therefore, the surface resistance value is preferably $1\times10^{7}$ [Ω/□] or more and $1\times10^{16}$ [Ω/□] or less.

Further, a structure may be employed in which the first potential regulating member is arranged so as to surround the entire circumference of the anode electrode.

Further, a structure may be employed in which the first potential regulating member is regulated to a ground potential.

Further, a structure may be employed in which the second potential regulating member is regulated to a ground potential.

An image display device according to the present invention further comprises a charging prevention film that is provided via an insulating layer in a part corresponding to a region where the anode electrode is formed on the surface on the opposite side of the surface having the first potential regulating member of the faceplate, in which, when it is assumed that a thickness of the faceplate is tg, a volume resistivity of the faceplate is ρg, a thickness of the insulating layer is tf and a volume resistivity of the insulating layer is ρf, $tg\times\rho g<0.1\times tf\times\rho f$ is satisfied. In this case, an electric field is not applied on a faceplate, thereby preventing deposition of alkaline ions on the surface of the faceplate.

An image display device according to the present invention further comprises a third potential regulating member regulated to a potential equivalent to that of the anode electrode in a part corresponding to a region where the anode electrode is formed on the surface on the opposite side of the surface having the first potential regulating member of the faceplate. In this case also, there is an effect of preventing deposition of alkaline ions on the surface of the faceplate.

Moreover, there may be employed a structure in which a charging prevention film is provided via an insulating layer on a surface on the opposite side of a surface opposed to the faceplate of the third potential regulating member. In this case, adhesion of dusts or the like due to electrification of a surface of the image display device could be avoided.

Further, a structure may be employed in which the electron beam source is a surface conduction electron-emitting device.

DETAILED DESCRIPTION OF THE PREFERRED EMBODIMENTS

Preferred embodiments of the present invention will be hereinafter described illustratively in detail with reference to the accompanying drawings. Note that dimensions, materials, shapes and relative arrangements of components described in the embodiments are not meant to limit a scope of the present invention only to them unless specifically described otherwise.

First Embodiment

Figure 1A:
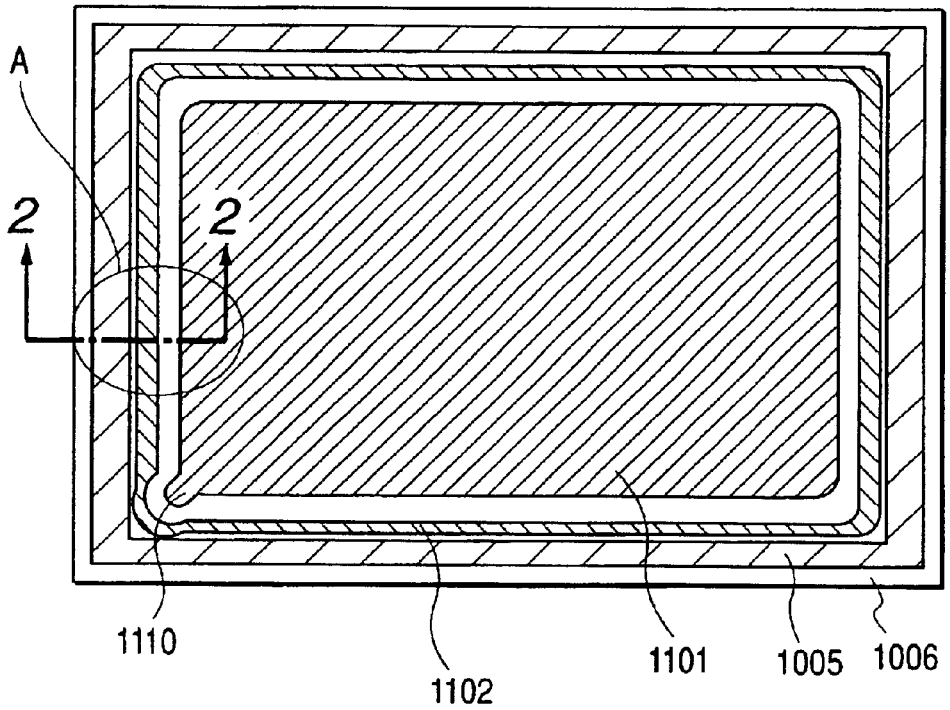
FIG. 1A is a schematic plan view of an image display device of a first embodiment of the present invention viewed from a faceplate side.
Figure 1B:
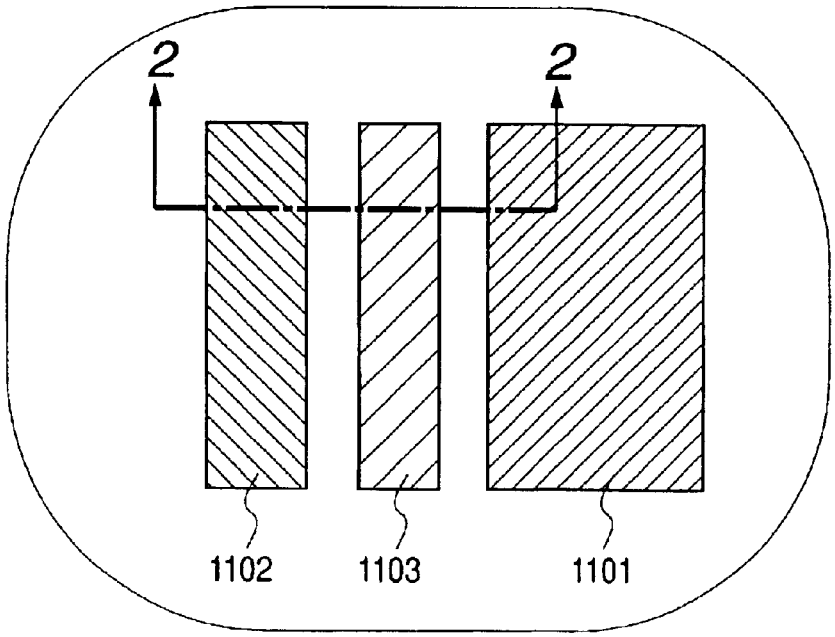
FIG. 1B is a view of an arrangement of electrodes in a part A in FIG. 1A viewed from above.
Figure 2:
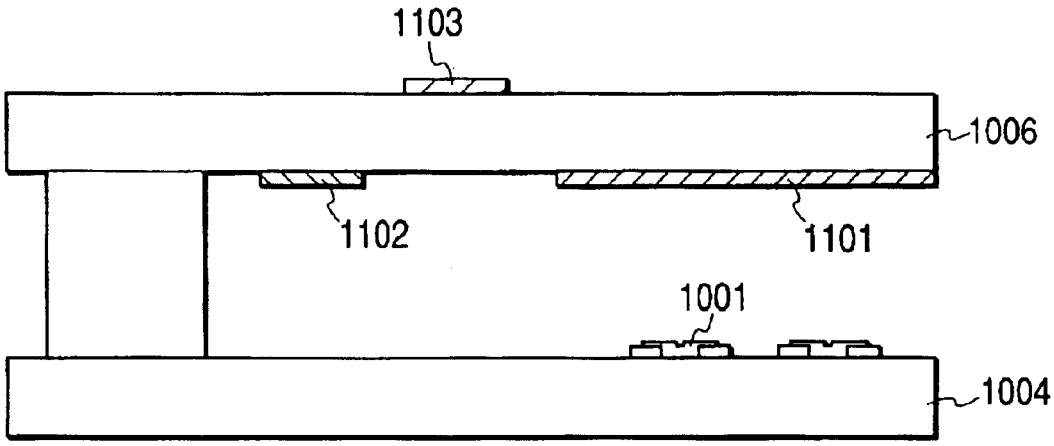
FIG. 2 is a schematic sectional view along a line 2—2 in FIGS. 1A and 1B.

A first embodiment of the present invention will be hereinafter described with reference to FIGS. 1A, 1B, and 2. FIGS. 1A and 1B are schematic plan views of an image display device of the first embodiment of the present invention viewed from a faceplate side. FIG. 2 is a schematic sectional view along a line 2—2 in FIGS. 1A and 1B.

A faceplate 1006 has an anode electrode 1101 containing an image display region, and an anode potential is supplied to the faceplate 1006 through a high voltage extracting portion 1110. A high voltage introducing terminal (not shown) is provided on the faceplate 1006 side in the high voltage extracting portion 1110 and is connected to a high voltage source. In addition, a first potential regulating member 1102, which is regulated to a ground potential (hereinafter referred to as "GND potential") over an entire circumference thereof, is provided around the anode electrode 1101 and the high voltage extracting portion 1110 on the faceplate 1006. The first potential regulating member 1102 relaxes an electric field in a part on the outside of the first potential regulating member 1102 and prevents break down from occurring between a sidewall 1005, a structure or the like (not shown) and the anode electrode 1101.

In addition, in the faceplate 1006, a second potential regulating member 1103, which is a characteristic component of the present invention, is arranged on the back of the surface on which the anode electrode 1101 and the first potential regulating member 1102 are present (on the atmosphere side of the faceplate 1006). This second potential regulating member 1103 is regulated to the GND potential.

As described above, the second potential regulating member 1103 is arranged on the atmosphere side of the faceplate 1006 and on the outside of an orthogonal projection region of the anode electrode 1101, whereby an electric field in the vicinity of the end of the first potential regulating member 1102 on the anode electrode 1101 side can be weakened, and a dielectric voltage between the first potential regulating member 1102 and the anode electrode 1101 can be increased.

The image display device with such a structure can be driven with a higher voltage compared with an image display device that does not have the second potential regulating member 1103. More specifically, when the image display device was driven with an anode voltage Va of 10 kV, no break down was observed and a satisfactory image display device could be obtained. Further, when the anode voltage Va was forcibly increased, no break down was observed until the anode voltage Va reached 15 kV.

A structure and a manufacturing method of a display panel of the image display device to which the present invention is applied will be hereinafter described with reference to a specific example.

Figure 3:
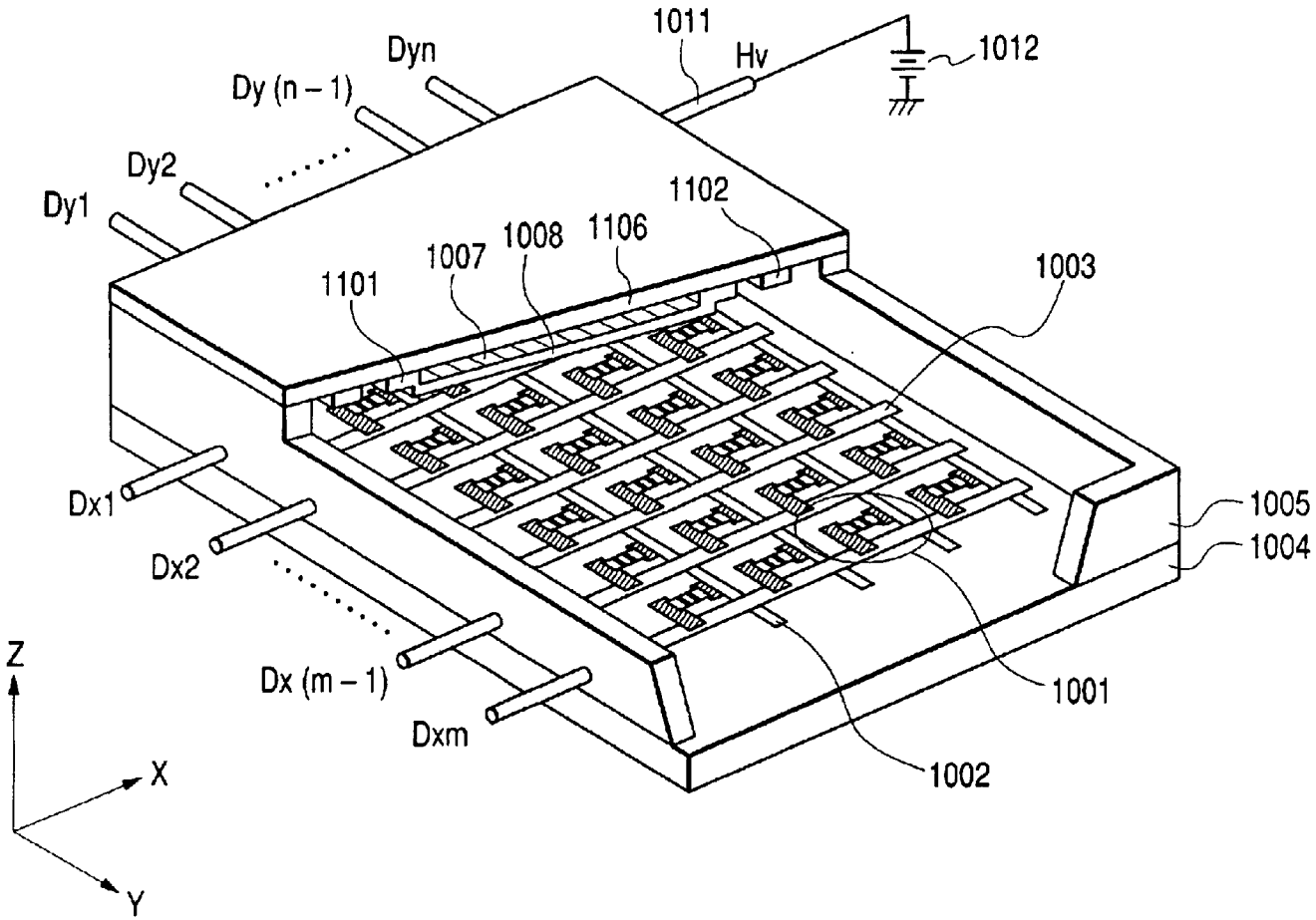
FIG. 3 is a perspective view showing a display panel in accordance with the first embodiment of the present invention with a part thereof cut away.

FIG. 3 is a perspective view of a display panel of this embodiment. The display panel is shown with a part thereof cut away in order to show its inside structure.

In the figure, reference numeral 1004 denotes an outer container bottom (which may also be referred to as "rear plate"); 1005, a sidewall; and 1006, a faceplate. An airtight container for maintaining the inside of the display panel in vacuum is formed by the rear plate 1004, the sidewall 1005, and the faceplate 1006.

In assembling the airtight container, it is necessary to seal a joint portion of each member in order to keep a sufficient strength and airtightness in the joint portion. In this embodiment, for example, frit glass was applied to the joint portion and baked for 10 minutes or more under 400 to 500 degrees Celsius in the air or a nitrogen atmosphere, whereby sealing was attained. A method of evacuating the airtight container to be vacuum will be described later.

Here, N×M surface conduction electron-emitting devices 1001, which are electron beam sources, are formed on the rear plate 1004. N and M are positive integers equal to or larger than two and are appropriately set according to the target number of display pixels. In this embodiment, it is assumed that N=1440 and M=480. N×M surface conduction electron-emitting devices 1001 are wired in a passive matrix shape by M row direction wirings 1002 and N column direction wirings 1003. Further, parts constituted by the surface conduction electron-emitting devices 1001, the row direction wirings 1002, and the column direction wirings 1003 are referred to as a multi-electron beam source.

In addition, in order to evacuate the airtight container to be vacuum, after the airtight container is assembled, an exhaust pipe (not shown) and a vacuum pump (not shown) are connected to evacuate inside of the airtight container to a vacuum degree in the order of $1\times10^{-5}$ [Pa]. Thereafter, the exhaust pipe is sealed. In order to maintain the vacuum degree in the airtight container, a getter film (not shown) is formed in a predetermined position in the airtight container immediately before the sealing or after the sealing. The getter film is a film that is, for example, formed by heating a getter material containing Ba as its main component by a heater or high frequency heating and evaporating the getter material. By an absorbing action of this getter film, the inside of the airtight container is maintained at a vacuum degree of $1\times10^{-3}$ to $1\times10^{-5}$ [Pa].

Next, the multi-electron beam source used in the display panel will be described.

The multi-electron beam source used in the image display device of the present invention is not limited in terms of a material, a shape or a manufacturing method of a cold cathode device as long as it is an electron source in which cold cathode devices are arranged in a passive matrix shape or a ladder shape. Therefore, for example, a cold cathode device such as a surface conduction electron-emitting device, an FE type cold cathode device, or an MIM type cold cathode device can be used.

However, under the circumstances in which a display device that has a large display screen and is inexpensive is demanded, the surface conduction electron-emitting device is particularly preferable among these cold cathode devices. That is, since an electron-emitting characteristic largely depends on relative positions and shapes of an emitter cone and a gate electrode, a manufacturing technique of an extremely high accuracy is required in the FE type cold cathode device. This is a disadvantageous factor for attaining increase in an area and decrease in manufacturing costs of the image display device. In addition, it is necessary to make the film thickness of an insulating layer and an upper electrode thin and uniform in the MIM type cold cathode device. This is also a disadvantageous factor for attaining increase in an area and decrease in manufacturing costs of the image display device. In that respect, in the surface conduction electron-emitting device, since a manufacturing method is relatively simple, it is easy to increase an area and reduce manufacturing costs of the image display device. In addition, the inventors of the present invention have found that a surface conduction electron-emitting device with an electron-emitting portion or its peripheral part formed of a particulate film is particularly excellent in an electron-emitting characteristic and can be easily manufactured among the surface conduction electron-emitting devices. Therefore, it can be said that such a surface conduction electron-emitting device is most preferable for use in a multi-electron beam source of an image display device with a high luminance and a large screen. Thus, in the display panel of this embodiment, the surface conduction electron-emitting device with the electron-emitting portion or its peripheral part formed of the particulate film is used. Note that description of a manufacturing method of the multi-electron beam source is omitted.

Next, a structure and a manufacturing method of the faceplate 1006 used in the display panel will be described with reference to a specific example.

Figure 4A:
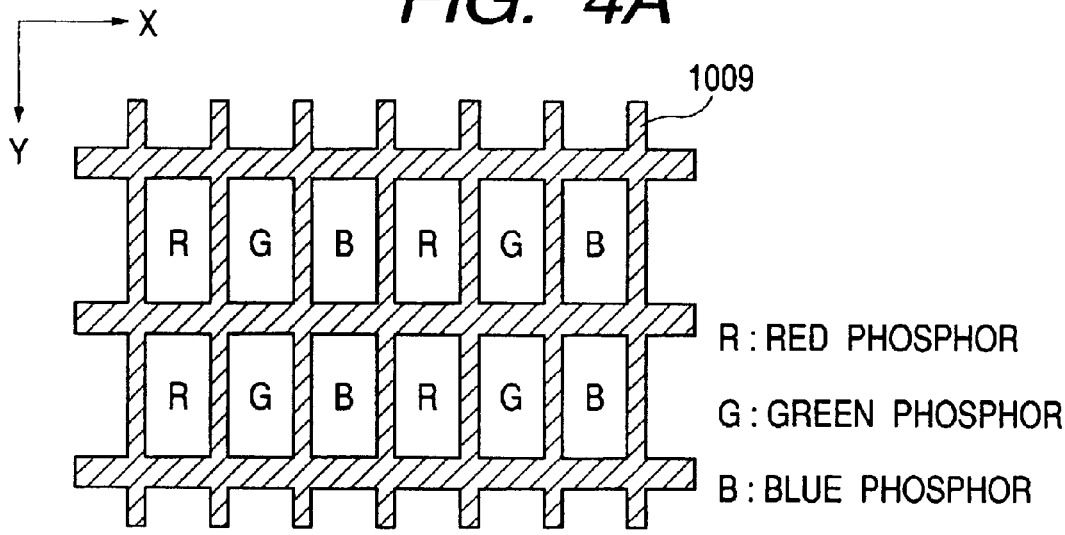
FIGS. 4A and 4B are views showing examples of a black matrix that is used in the image display device of the present invention.

As a substrate of the faceplate 1006, glass such as soda-lime glass, glass with a reduced content of impurities such as Na, and glass containing alkaline-earth metals as components and having an increased electric insulating characteristic (PD200 manufactured by Asahi Glass Co., Ltd., etc) can be used. In this embodiment, PD200 manufactured by Asahi Glass Co., Ltd. was used. After cleaning and drying a substrate consisting of this PD200, a glass paste and a paste containing a black pigment and silver particles were used to manufacture a black matrix 1009 of a matrix shape as shown in FIG. 4A and the high voltage extracting portion 1110 on the substrate with a thickness of 10 $\mu$m by a screen printing method. At the same time, the first potential regulating member 1102 was formed on the substrate with a thickness of 10 $\mu$m so as to be arranged in a position shown in FIG. 2. In this case, a distance from the anode electrode 1101 consisting of the black matrix and a metal back discussed later to the first potential regulating member 1102 is set to 4.0 mm. Further, although the respective portions are formed in the dimensions as described above in this embodiment, it is needless to mention that the portions are not limited to these dimensions. However, since the respective portions of the display panel other than the image display region are desired to be small in size, it is preferable to adopt the dimensions as described above for these portions.

Figure 4B:
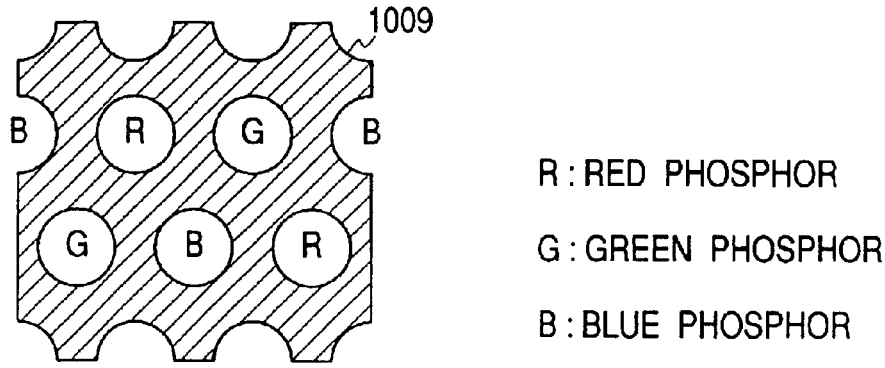

The black matrix 1009 is provided for the purposes of preventing color mixing of phosphors, preventing color drift from being caused even if electron beams somewhat deviate, absorbing external light to improve contrast of an image, and the like. Although the black matrix 1009 is manufactured by the screen printing method in this embodiment, it is needless to mention that a manufacturing method of the black matrix 1009 is not limited to this, and the black matrix 1009 may be manufactured using, for example, the photolithography method. In addition, although the glass paste and the paste containing a black pigment and silver particles are used as materials of the black matrix 1009 in this embodiment, it is needless to mention that the materials of the black matrix 1009 are not limited to these, and carbon black and the like may be used. Further, although the black matrix 1009 is manufactured in the matrix shape as shown in FIG. 4A in this embodiment, it is needless to mention that a shape of the black matrix 1009 is not limited to this but may be a delta-like arrangement as shown in FIG. 4B, a stripe-like arrangement (not shown), or other arrangements.

Next, a phosphor film 1007 of three colors (see FIG. 3) was manufactured in three times for each color by the screen printing method using red, blue and green phosphor pastes in the opening portion of the black matrix 1009 shown in FIG. 4A. Although the phosphor film was manufactured using the screen printing method in this embodiment, it is needless to mention that a manufacturing method of the phosphor film is not limited to this, and the phosphor film may be manufactured by, for example, the photolithography method. In addition, a phosphor of P22 used in the field of CRTs was used as the phosphor. As color phosphors, "P22-RE3: Y202S:$Eu^{3+}$" (red), "P22-B2; ZnS:Ag, Al" (blue), and "P22-GN4; ZnS: Cu, Al" (green) were used, respectively. However, it is needless to mention that the phosphors are not limited to these, and other phosphors may be used.

Next, a resin intermediate film was manufactured by the filming process that is publicly known in the field of cathode-ray tubes. Thereafter, a metal evaporation film (consisting of Al in this embodiment) was manufactured. Lastly, a metal back 1008 with a thickness of 100 nm was manufactured by thermally decomposing and removing the resin intermediate layer.

Next, a manufacturing method of the second potential regulating member 1103 arranged in the faceplate 1006, which is a characteristic component of the present invention, will be described.

First, as the second potential regulating member 1103, an Al thin film of 100 nm was manufactured by the vacuum evaporation method in a region between the anode electrode 1101 and the first potential regulating member 1102 on the atmosphere side of the faceplate 1006 (back surface side of the anode electrode 1101 and the like) as shown in FIG. 2. Although the second potential regulating member 1103 was formed by the vacuum evaporation method in this embodiment, it is needless to mention that a manufacturing method of the second potential regulating member 1103 is not limited to this, and the second potential regulating member 1103 may be formed by, for example, the sputtering method and the CVD method.

In this embodiment, the Al thin film with the thickness of 100 nm manufactured by the vacuum evaporation method was used as a material of the second potential regulating member 1103. However, it is sufficient to select a material having a resistance value that is low enough such that a potential can be regulated as the material of the second potential regulating member 1103. The material can be appropriately selected from metals such as Ni, Cr, Au, Mo, W, Pt, Ti, Al, Cu and Pd or alloys of these metals, print conductors constituted by metals or metal oxides such as Pd, Ag, Au, $RuO_2$, and Pd—Ag, glass and the like, transparent conductors such as $In_2O_3$—$SnO_2$, semiconductor materials such as polysilicon, tapes to which conductivity is imparted, metal blocks such as a housing of an image display panel, and the like.

Thereafter, the anode electrode 1101 of the faceplate 1006 manufactured in this way was connected to a high voltage source 1012 via the high voltage introducing terminal 1011. In addition, the first potential regulating member 1102 and the second potential regulating member 1103 were connected to the GND potential.

The display panel of the image display device to which the present invention is applied is manufactured by the process described above.

Other Embodiments

Next, other embodiments of the image display device of the present invention will be described. Note that, since second and subsequent embodiments have the same overall structure of the image display device as that of the first embodiment, only characteristic parts will be described in each embodiment.

Second Embodiment

Figure 5:
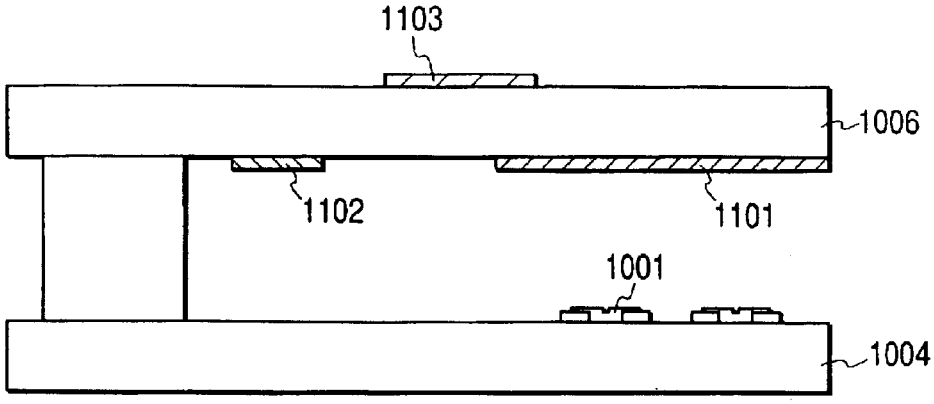
FIG. 5 is a schematic sectional view of an image display device in accordance with a second embodiment of the present invention.

A second embodiment of the present invention will be described with reference to FIG. 5. FIG. 5 is a schematic sectional view of an image display device in accordance with the second embodiment of the present invention.

In the image display device in accordance with the second embodiment, the faceplate 1006 also has the anode electrode 1101 containing an image region and the first potential regulating member 1102 arranged over the entire circumference of the faceplate 1006. Consequently, an electric field in the part on the outside of the first potential regulating member 1102 is relaxed to prevent break down from occurring between a sidewall (not shown), structure or the like and the anode electrode 1101. In addition, in the faceplate 1006, the second potential regulating member 1103, which is a characteristic component of the present invention, is arranged on the back of the surface on which the anode electrode 1101 and the first potential regulating member 1102 are present. Further, this second potential regulating member 1103 is regulated to the GND potential.

As shown in FIG. 5, the second potential regulating member 1103 in this embodiment is formed in a region between the anode electrode 1101 and the first potential regulating member 1102 on the atmosphere side of the faceplate 1006 (side on which the anode electrode 1101 and the like are not formed (back surface side)), which is a region overlapping an orthogonal projection of the external circumferential end of the anode electrode 1101. Moreover, the second potential regulating member 1103 in this embodiment is constituted by ITO ($In_2O_3$—$SnO_2$) of 200 nm formed by the sputtering method. By constituting the second potential regulating member 1103 by a transparent electrode such as ITO, it is possible to make it hard for a user to recognize the second potential regulating member 1103 when the user looks at the display panel.

The image display device with such a structure can be driven with a higher voltage compared with an image display device that does not have the second potential regulating member 1103. More specifically, when the image display device was driven with an anode voltage Va of 10 kV, no break down was observed and a satisfactory image display device could be obtained. Further, when the anode voltage Va was forcibly increased, no break down was observed until the anode voltage Va reached 20 kV.

Third Embodiment

Figure 6:
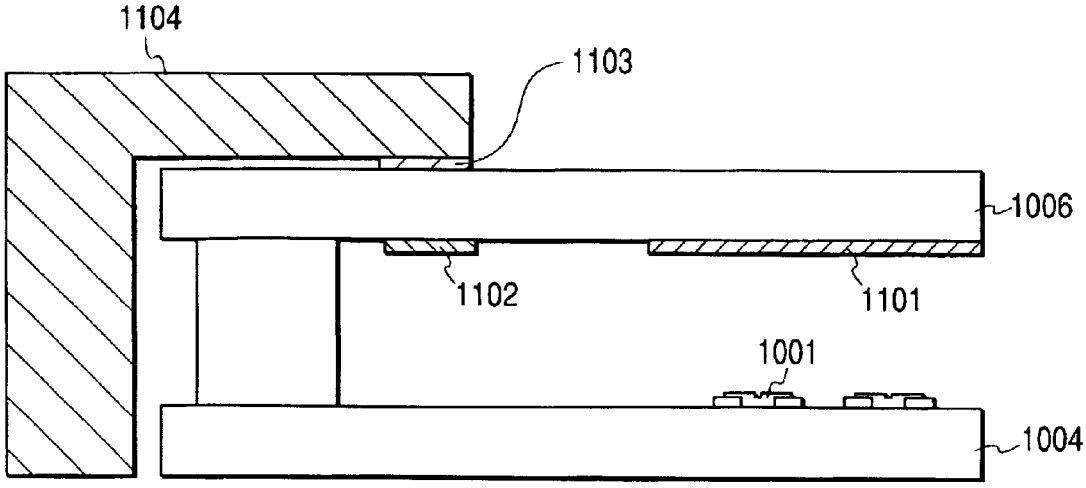
FIG. 6 is a schematic sectional view of an image display device in accordance with a third embodiment of the present invention.

Next, a third embodiment of the present invention will be described with reference to FIG. 6. FIG. 6 is a schematic sectional view of an image display device in accordance with the third embodiment of the present invention.

In this embodiment, as shown in FIG. 6, the second potential regulating member 1103 consists of a metal portion of a display panel housing 1104 that contacts a region on the atmosphere side of the faceplate 1006 (back surface side of the anode electrode 1101 and the like), which extends from the end of the faceplate 1006 to a position corresponding to an orthogonal projection of the end of the first potential regulating member 1102 on the anode electrode 1101 side. That is, the second potential regulating member 1103 is arranged so as to overlap an orthogonal projection of the entire first potential regulating member 1102. This second potential regulating member 1103, that is, the metal portion of the display panel housing 1104, is regulated to the GND potential. Further, as in this embodiment, a first potential regulating member and a second potential regulating member on a surface on the atmosphere side of a faceplate has a positional relation in which the second potential regulating member covers a region corresponding to the end of the first potential regulating member on an anode electrode side. This positional relation corresponds to a part equivalent to a region between the first potential regulating member and the anode electrode defined by the present invention.

In this embodiment, the display panel housing 1104 is used as the second potential regulating member 1103, whereby it becomes unnecessary to manufacture a potential regulating member anew on the faceplate 1006. Thus, it becomes possible to realize cost reduction of the image display device.

The image display device with such a structure can be driven with a higher voltage compared with an image display device that does not have the second potential regulating member 1103. More specifically, when the image display device was driven with an anode voltage Va of 10 kV, no break down was observed and a satisfactory image display device could be obtained. Further, when the anode voltage Va was forcibly increased, no break down was observed until the anode voltage Va reached 12 kV.

Fourth Embodiment

Figure 7:
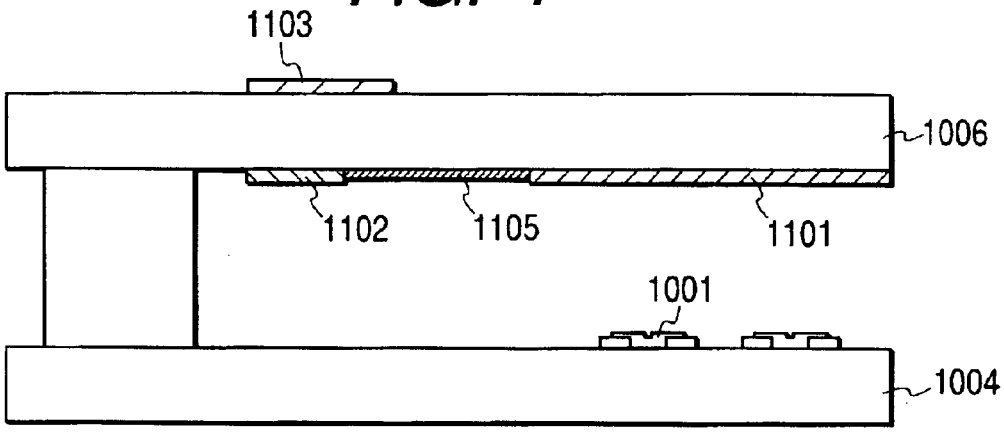
FIG. 7 is a schematic sectional view of an image display device in accordance with a fourth embodiment of the present invention.

A fourth embodiment of the present invention will be described with reference to FIG. 7. FIG. 7 is a schematic sectional view of an image display device in accordance with the fourth embodiment of the present invention.

In this embodiment, a film (not shown) spray-coated with a compound of particulates of tin oxide ($SnO_2$) and silica is formed as the second potential regulating member 1103 in a part on the atmosphere side of the faceplate 1006 (back surface side of the anode electrode 1101 and the like) from a region of an orthogonal projection of the entire first potential regulating member 1102 to a region between the anode electrode 1101 and the first potential regulating member 1102. This film is regulated to the GND potential. Further, since the second potential regulating member 1103 is thus formed of a generally transparent material consisting of the particulates of tin oxide and silica, it is possible to make it hard for an observer to recognize the second potential regulating member 1103.

In addition, when a creeping surface between the first potential regulating member 1102 and the anode electrode 1101 of the faceplate 1006 (surface of the faceplate substrate) is made of glass (dielectric body), since the creeping surface becomes a triple point as described before and concentration of an electric field occurs or the creeping surface is charged, the faceplate 1006 becomes a cause of break down. Thus, the image display apparatus of this embodiment is provided with a high resistance film 1105 on the glass surface. An electric current of a magnitude found by dividing a voltage between the first potential regulating member 1102 and the anode electrode 1101 (anode voltage Va) by a resistance value Rs of the high resistance film 1105 is flown to the high resistance film 1105. Thus, from the viewpoint of preventing charge and reducing power consumption, the resistance value Rs of the high resistance film 1105 is set to a desirable range. From the viewpoint of preventing charge, a surface resistance (Ω/□) of the high resistance film 1105 is preferably $1\times10^{16}$ Ω/□ or less. Moreover, in order to obtain a sufficient charging prevention effect, the surface resistance (Ω/□) of the high resistance film 1105 is more preferably $1\times10^{14}$ Ω/□ or less. On the other hand, a lower limit value of the surface resistance is preferably $1\times10^{7}$ [Ω/□] or more, although it depends on a shape of a part where the high resistance film 1105 is formed and a voltage applied between electrodes.

As a material of the high resistance film 1105, for example, metal oxides can be used. Among the metal oxides, oxides of chromium, nickel, and copper are preferable. This is because these oxides are considered to have a relatively low secondary electron emitting efficiency and tend not to be charged. Other than the metal oxides, carbon is preferable as a material of the high resistance film 1105 because it has a low secondary electron emitting efficiency.

As other materials of the high resistance film 1105, a nitride of germanium and transition metal alloy is preferable because it can control a resistance value in a wide range from a highly conductive body to an insulating body by adjusting a composition of transition metals. These materials are stable materials with little change in a resistance value in a manufacturing process of the image display device. As transition metal elements, for example, there are Ti, V, Cr, Mn, Fe, Co, Ni, Cu, Zr, Nb, Mo, Hf, and W.

A nitride film is formed on an insulating member by thin film forming means such as the reactive sputtering, electron beam evaporation, ion plating, or ion assist evaporation method in a nitrogen gas atmosphere. A metal oxide film can be manufactured by the same thin film forming method. However, in this case, oxygen gas is used instead of nitrogen gas. In addition, the metal oxide film can also be formed by the CVD method, or the alkoxide application method. When a carbon film is used, it is formed by the evaporation method, the sputtering method, the CVD method or the plasma CVD method. In particular, when an amorphous carbon film is formed, hydrogen is contained in an atmosphere during film formation or hydrocarbon gas is used as film forming gas.

In the high resistance film 1105 of this embodiment, a nitride of germanium and tungsten manufactured by the sputtering method was used as a charging preventing film. When a surface resistance value Rs of this high resistance film 1105 was measured, it was $2\times10^{11}$ [Ω/□].

The image display device having such a structure can be driven with a higher voltage compared with an image display device that does not have the second potential regulating member 1103. More specifically, when the image display device was driven with an anode voltage Va of 10 kV, no break down was observed and a satisfactory image display device could be obtained. Further, when the anode voltage Va was forcibly increased, no break down was observed until the anode voltage Va reached 18 kV.

Fifth Embodiment

Figure 8:
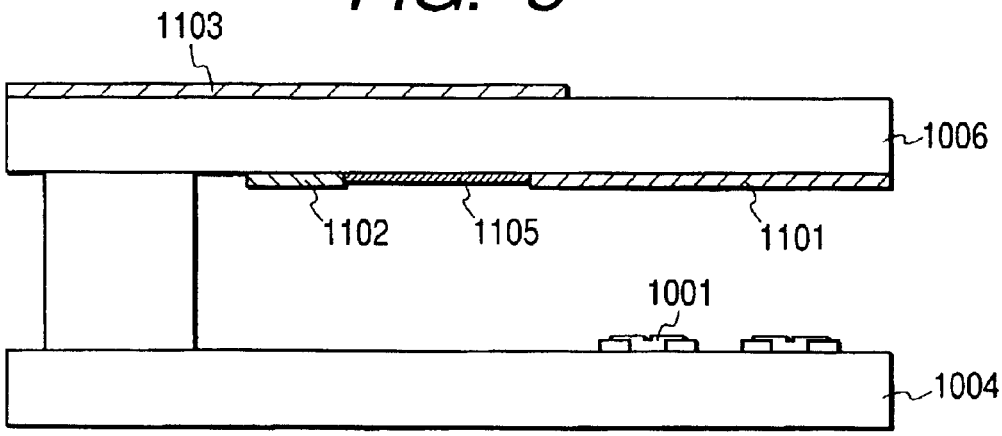
FIG. 8 is a schematic sectional view of an image display device in accordance with a fifth embodiment of the present invention.

Next, a fifth embodiment of the present invention will be described with reference to FIG. 8. FIG. 8 is a schematic sectional view of an image display device in accordance with the fifth embodiment of the present invention.

In this embodiment, as the second potential regulating member 1103, a conductive tape provided with a pressure-sensitive adhesive, in which conductive particulates were mixed on a substrate consisting of copper, is pasted to a part on the atmosphere side of the faceplate 1006 (back surface side of the anode electrode 1101 and the like) from the end of the faceplate 1006 to an orthogonal projection of the external circumferential end of the anode electrode 1101. This film is regulated to the GND potential. In this way, the second potential regulating member 1103 is formed of the conductive tape, whereby it becomes possible to easily arrange the second potential regulating member 1103 after forming a display panel. Thus, even if inadequacy occurs when the display panel is formed, since the second potential regulating member 1103 is never wasted, it becomes possible to realize cost reduction of the image display device.

In this embodiment, the high resistance film 1105 is also formed on the creeping surface between the first potential regulating member 1102 and the anode electrode 1101 of the faceplate 1006 due to the reason described in the fourth embodiment. As the high resistance film 1105, a film manufactured by the spray method in which graphite particles were scattered with an appropriate density was used. When a surface resistance value Rs of this high resistance film 1105 was measured, it was $5\times10^{14}$ [Ω/□].

The image display device having such a structure can be driven with a higher voltage compared with an image display device that does not have the second potential regulating member 1103. More specifically, when the image display device was driven with an anode voltage Va of 10 kV, no break down was observed and a satisfactory image display device could be obtained. Further, when the anode voltage Va was forcibly increased, no break down was observed until the anode voltage Va reached 23 kV.

Sixth Embodiment

Figure 9:
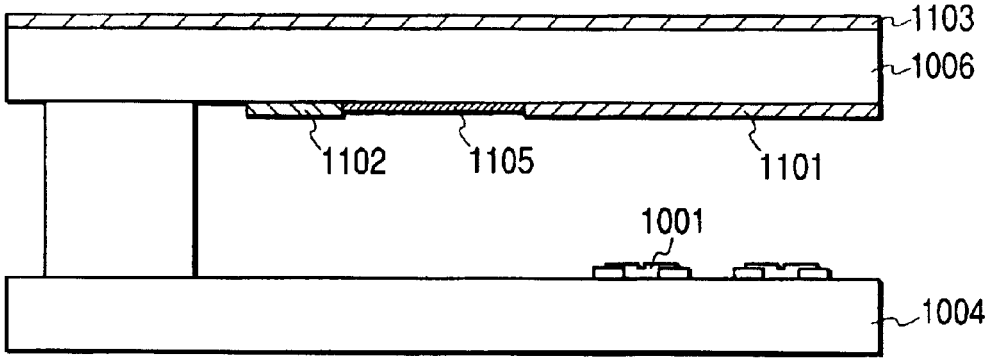
FIG. 9 is a schematic sectional view of an image display device in accordance with a sixth embodiment of the present invention.

Next, a sixth embodiment of the present invention will be described with reference to FIG. 9. FIG. 9 is a schematic sectional view of an image display device in accordance with the sixth embodiment of the present invention.

In this embodiment, as the second potential regulating member 1103, a laminated film of an ITO ($In_2O_3$—$SnO_2$) film and an $SiO_2$ film is provided over substantially the entire surface on the atmosphere side of the faceplate 1006 (back surface side of the anode electrode and the like). This laminated film is regulated to the GND potential. In this way, the laminated film functioning as an electrode regulated to the GND potential is provided on substantially the entire surface on the atmosphere side of the faceplate 1006, whereby a potential on the atmosphere side of the faceplate 1006 stops rising and the image display device can be driven more steadily. In addition, the second potential regulating member 1103 is constituted by the laminated film of ITO and SiO2, whereby it also becomes possible to cause the second potential regulating member 1103 to function as an AR (anti-reflection) layer for reducing reflection of external light.

In addition, in this embodiment, the high resistance film 1105 is also provided on the creeping surface between the first potential regulating member 1102 and the anode electrode 1101 of the faceplate 1006 due to the reason described in the fourth embodiment. As the high resistance film 1105, a film manufactured by the spray method in which graphite particles were dispersed with an appropriate density was used. When a surface resistance value Rs of this high resistance film 1105 was measured, it was $5\times10^{14}$ [Ω/□].

The image display device having such a structure can be driven with a higher voltage compared with an image display device that does not have the second potential regulating member 1103. More specifically, when the image display device was driven with an anode voltage Va of 10 kV, no break down was observed and a satisfactory image display device could be obtained. Further, when the anode voltage Va was forcibly increased, no break down was observed until the anode voltage Va reached 23 kV.

Seventh Embodiment

Figure 10:
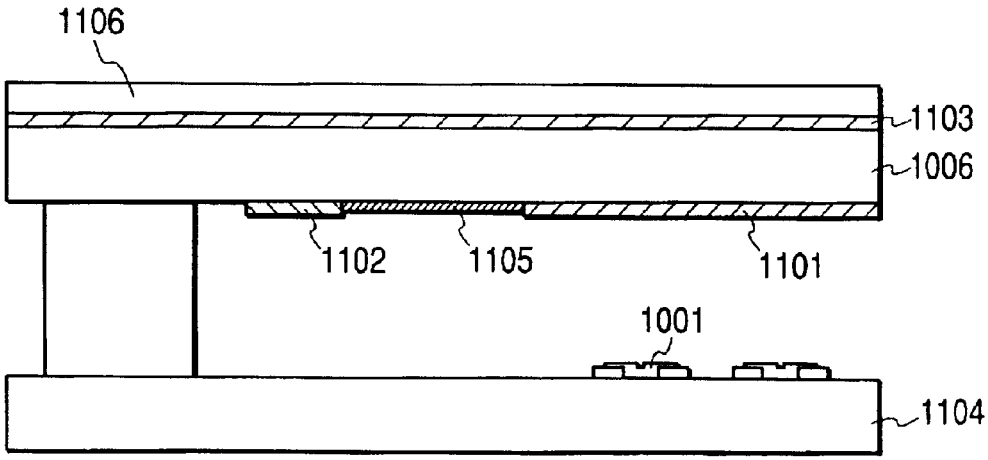
FIG. 10 is a schematic sectional view of an image display device in accordance with a seventh embodiment of the present invention.

Next, a seventh embodiment of the present invention will be described with reference to FIG. 10. FIG. 10 is a schematic sectional view of an image display device in accordance with the seventh embodiment of the present invention.

In this embodiment, as the second potential regulating member 1103, a film provided with a pressure-sensitive adhesive (the part where this pressure-sensitive adhesive exists becomes the second potential regulating member 1103), in which conductive particulates are dispersed on a transparent film base material 1106, is pasted over substantially the entire surface on the atmosphere side of the faceplate 1006 (back surface side of the anode electrode 1101 and the like). The surface of the faceplate 1006 is regulated to the GND potential. The pressure-sensitive adhesive having the conductive particulates dispersed therein in this way can regulate the surface on the atmosphere side of the faceplate 1006 to the GND potential and can realize a function as a potential regulating member by decreasing a resistant value of the pressure-sensitive adhesive part to be lower than a resistance value of the faceplate 1006. In addition, the transparent film is pasted over the entire surface of the faceplate 1006 as described above. Consequently, even if the faceplate of the image display device should be broken, since scattering of glass can be prevented, safety of the image display device can be improved.

In addition, in this embodiment, the high resistance film 1105 is provided on the creeping surface between the first potential regulating member 1102 and the anode electrode 1101 of the faceplate 1006 due to the reason described in the fourth embodiment. As the high resistance film 1105, a film manufactured by the spray method in which graphite particles were dispersed with an appropriate density was used. When a surface resistance value Rs of this high resistance film 1105 was measured, it was $5\times10^{14}$ [Ω/□].

The image display device having such a structure can be driven with a higher voltage compared with an image display device that does not have the second potential regulating member 1103. More specifically, when the image display device was driven with an anode voltage Va of 10 kV, no break down was observed and a satisfactory image display device could be obtained. Further, when the anode voltage Va was forcibly increased, no break down was observed until the anode voltage Va reached 23 kV.

Eighth Embodiment

Figure 11:
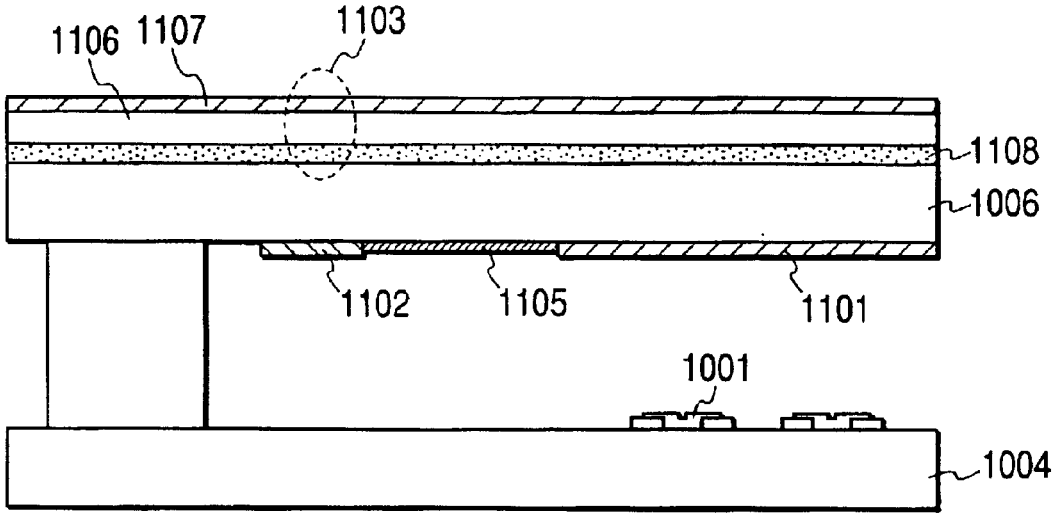
FIG. 11 is a schematic sectional view of an image display device in accordance with an eighth embodiment of the present invention.
Figure 12A:
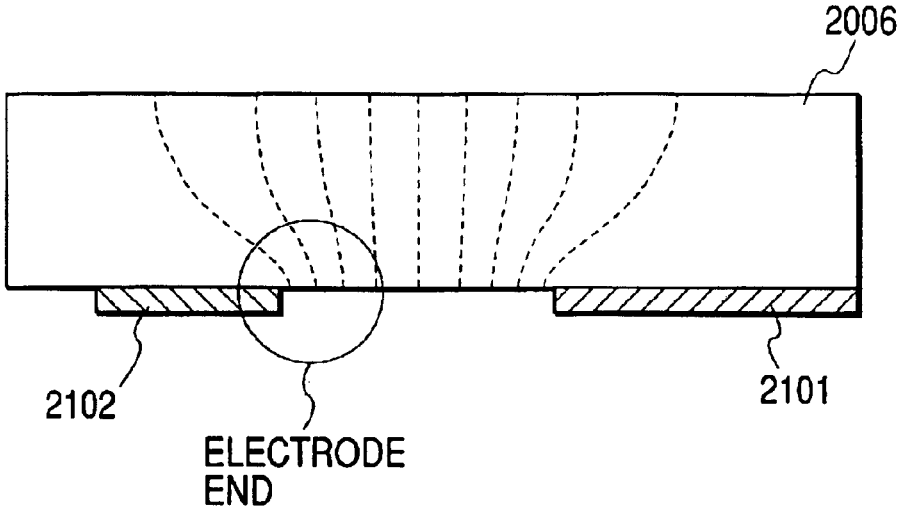
FIGS. 12A and 12B are sectional views showing potential distributions inside a faceplate.
Figure 12B:
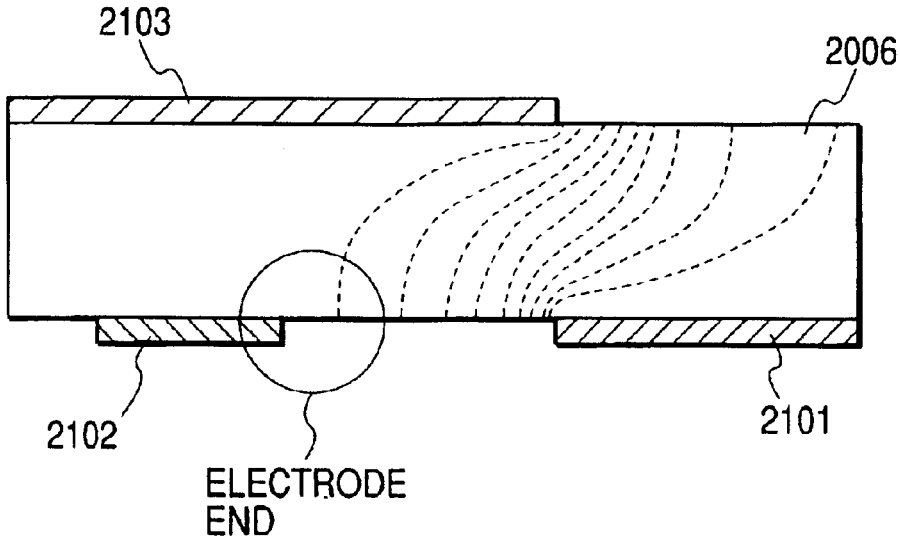
Figure 13:
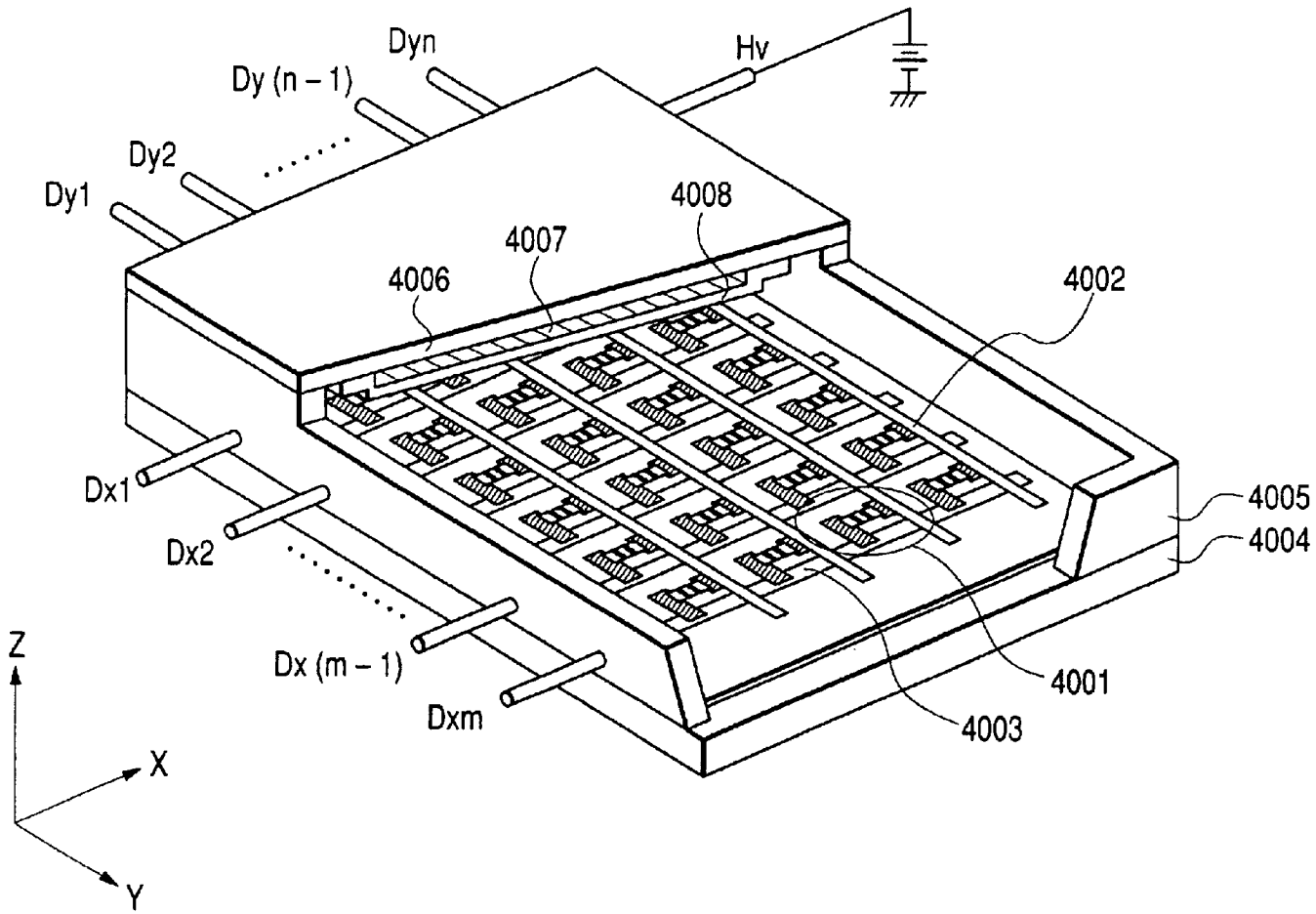
FIG. 13 is a perspective view showing a display panel of a conventional image display device with a part thereof cut away.
Figure 14:
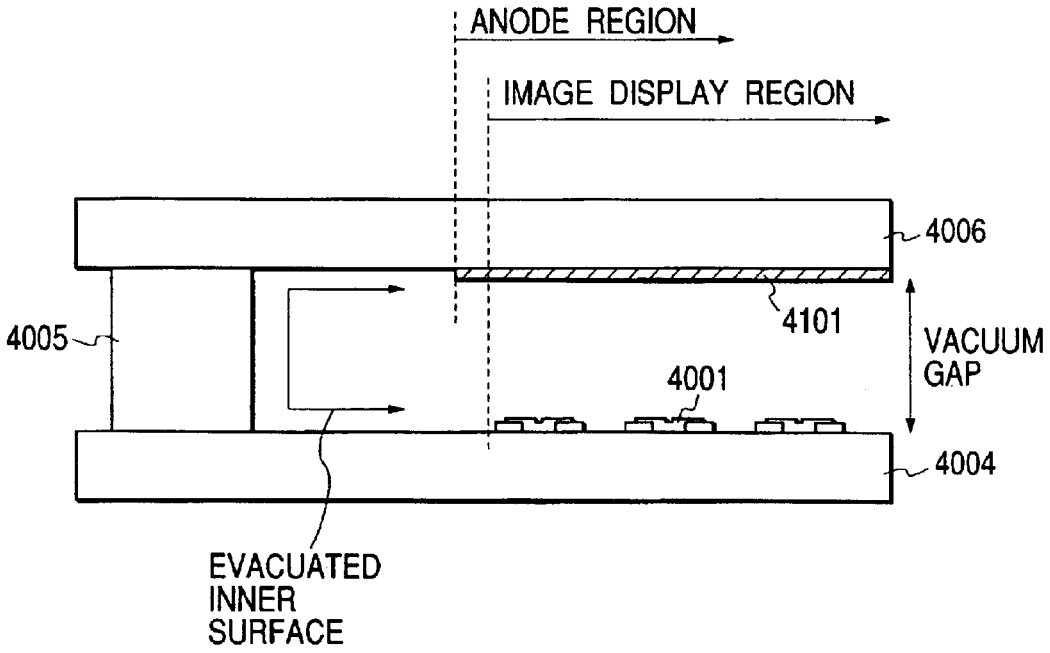
FIG. 14 is a view schematically showing a section of the display panel of the image display device shown in FIG. 13.
Figure 15:
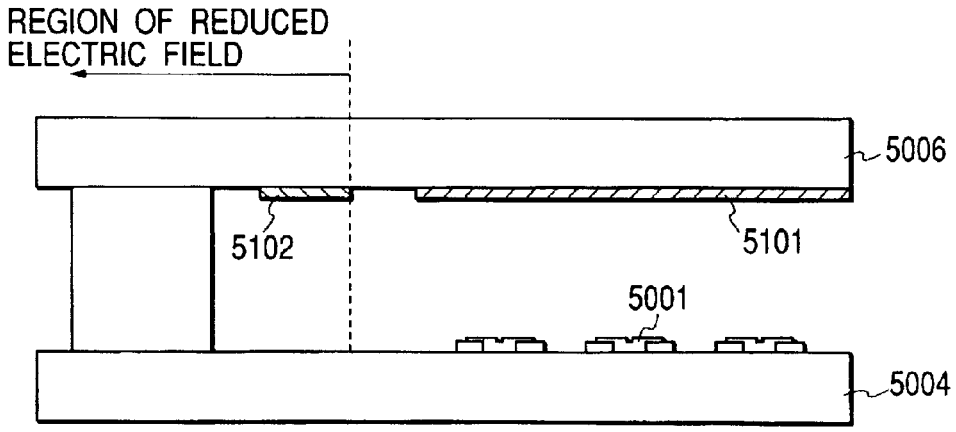
FIG. 15 is a schematic sectional view of another conventional display panel.

Next, an eighth embodiment of the present invention will be described with reference to FIG. 11. FIG. 11 is a schematic sectional view of an image display device in accordance with the eighth embodiment of the present invention.

In this embodiment, as the second potential regulating member 1103, a film provided with a pressure-sensitive adhesive 1108 and a conductive film 1107 on the transparent film base material 1106 is pasted over substantially the entire surface on the atmosphere side of the faceplate 1006 (back surface side of the anode electrode 1101 and the like). The conductive film 1107 in the film is regulated to the GND potential. With such a structure, a potential on the surface on the atmosphere side of the faceplate 1006 depends on a ratio of resistance values of the pressure-sensitive adhesive 1108, the film base material 1106, and the conductive film 1107 and a resistance value of the substrate of the faceplate 1006. For example, if the resistance value of the faceplate 1006 is sufficiently larger than the resistance values of the pressure-sensitive adhesive 1108, the film base material 1106, and the conductive film 1107, the surface on the atmosphere side of the faceplate 1006 is generally equal to the GND potential. In this embodiment, PD 200 manufactured by Asahi Glass Co., Ltd. that is glass with less alkaline content with a thickness of 2.8 mm is used as a substrate of the faceplate 1006. Thus, the pressure-sensitive adhesive 1108 was formed so as to have a thickness of 0.05 mm using an acrylic pressure-sensitive adhesive material in which transparent particulates such as ITO are dispersed and the film base material 1106 was formed so as to have a thickness of 0.1 mm using TAC (cellulose triacetate) such that a potential on the surface on the atmosphere side of the faceplate 1006 was generally equal to the GND potential.

In addition, if a material with a large content of sodium such as soda-lime glass is used in the faceplate 1006, it is preferable to make the potential on the surface on the atmosphere side of the faceplate 1006 to be generally equal to the Va voltage in order to prevent movement of sodium atoms in the faceplate 1006. Thus, if the faceplate 1006 consists of, for example, soda-lime glass with a thickness of 2.8 mm, it is sufficient to form the pressure-sensitive adhesive 1108 so as to have a thickness of 0.05 mm using an acrylic pressure-sensitive adhesive material and to form the film base material 1106 so as to have a thickness of 0.3 mm using PET (polyethylene terephthalate). Further, the transparent film is pasted over the entire surface of the faceplate 1006 as described above. Consequently, even if the faceplate of the image display device should be broken, since scattering of glass can be prevented, safety of the image display device can be improved.

In addition, in this embodiment, the high resistance film 1105 is also provided on the creeping surface between the first potential regulating member 1102 and the anode electrode 1101 of the faceplate 1006 due to the reason described in the fourth embodiment. As the high resistance film 1105, a film manufactured by the spray method in which graphite particles were dispersed with an appropriate density was used. When a surface resistance value Rs of this high resistance film 1105 was measured, it was $5\times10^{14}$ [Ω/□].

The image display device having such a structure can be driven with a higher voltage compared with an image display device that does not have the second potential regulating member 1103. More specifically, when the image display device was driven with an anode voltage Va of 10 kV, no break down was observed and a satisfactory image display device could be obtained. Further, when the anode voltage Va was forcibly increased, no break down was observed until the anode voltage Va reached 23 kV.

Ninth Embodiment

This embodiment is the same as the first embodiment in the structure except that a resistance value of the first potential regulating member 1102 of the first embodiment is larger than a resistance value of the anode electrode 1101. More specifically, an Al metal back covers a black matrix and phosphors such that the external circumference of the anode electrode 1101 is regulated by the Al metal back. In addition, a resistance value of the Al metal back is set to be extremely low at 2.5 Ω. Further, a guard electrode of 10 kΩ consisting of a compound of carbon and frit glass was used as the first potential regulating member 1102.

The image display device having such a structure can be driven with a higher voltage compared with an image display device that does not have the second potential regulating member 1103. More specifically, when the image display device was driven with an anode voltage Va of 10 kV, no break down was observed and a satisfactory image display device could be obtained. In addition, when the anode voltage Va was forcibly increased, break down was observed when it was 25 kV. However, a magnitude of the discharge was decreased by a current limiting resistor function of the first potential regulating member 1102. There was little damage to the image display device. More specifically, there was little damage to the metal back and the guard electrode (first potential regulating member 1102). Therefore, the image display device was capable of performing satisfactory image display even after the break down was observed.

Tenth Embodiment

This embodiment is the same as the ninth embodiment in the structure except that the part between the anode electrode 1101 and the first potential regulating member 1102 in the structure of the ninth embodiment is covered by a high resistance film.

More specifically, the same nitride film consisting of tungsten and germanium as in the fourth embodiment was used as the high resistance film. With such a structure, the high resistance film can withstand a stronger electric field. That is, as described above, it becomes possible to apply a higher voltage to the anode electrode 1101 and to arrange the anode electrode 1101 and the first potential regulating member 1102 more closely to each other.

The image display device having such a structure can be driven with a higher voltage compared with an image display device that does not have the second potential regulating member 1103. More specifically, when the image display device was driven with an anode voltage Va of 10 kV, no break down was observed and a satisfactory image display device could be obtained. In addition, when the anode voltage Va was forcibly increased in this embodiment, no break down was observed either when the anode voltage Va was 25 kV. When the anode voltage Va was further increased, break down was observed when it reached 27 kV. However, a magnitude of the discharge was decreased by a current limiting resistor function of the first potential regulating member 1102. There was little damage to the image display device. More specifically, there was little damage to the metal back and the guard electrode (first potential regulating member 1102). Therefore, the image display device was capable of performing satisfactory image display even after the break down was observed.

Eleventh Embodiment

In eleventh to thirteenth embodiments below, preferred embodiments of the present invention will be described.

In the embodiments described below, a potential in an orthogonal projection region of an anode electrode on a surface on the opposite side of a surface of a faceplate on which a first potential regulating member and the anode electrode are provided is set to substantially the same degree as an anode potential. Consequently, there is avoided deterioration of an image caused by deposition of alkaline ions on the surface of the faceplate. Note that, here, substantially the same potential as the anode potential means a potential within a range of ±10% of the anode potential.

An eleventh embodiment of the present invention will be hereinafter described with reference to FIG. 16.

Figure 16:
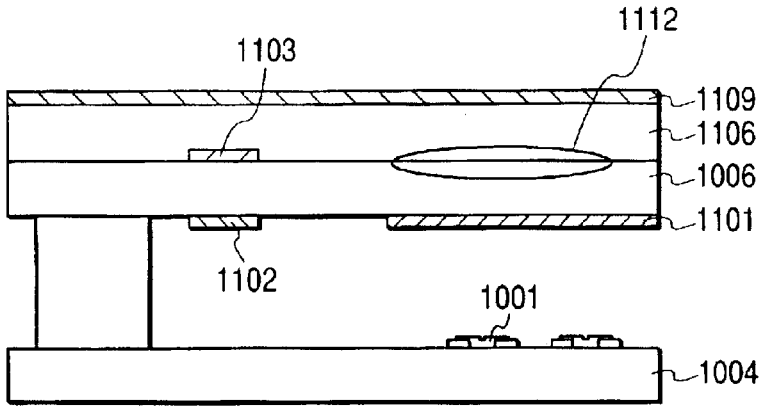
FIG. 16 is a schematic sectional view of an image display device in accordance with an eleventh embodiment of the present invention.

FIG. 16 shows a schematic sectional view cut along the line 2—2 of FIGS. 1A and 1B. The faceplate 1006 made of soda-lime glass with a thickness of 3 mm has the anode electrode 1101 containing an image display region, and an anode potential is supplied to the faceplate 1006 through the high voltage extracting portion 1110. A not-shown high voltage introducing terminal is provided on the faceplate 1006 side in the high voltage extracting portion 1110 and is connected to a high voltage source. In addition, the first potential regulating member 1102, which is regulated to the GND potential over an entire circumference thereof, is provided around the anode electrode 1101 and the high voltage extracting portion 1110 on the faceplate 1006. The first potential regulating member 1102 relaxes an electric field in a part on the outside of the first potential regulating member 1102 and prevents break down from occurring between the sidewall 1005, a not-shown structure or the like and the anode electrode 1101. A charging prevention film 1109 is provided on the outside of the faceplate 1006 via an insulating film (insulating layer) 1106. In this embodiment, polyethylene terephthalate (PET) was used as a material of the insulating film 1106, and a transparent conductive film of ITO was manufactured as the charging prevention film 1109. However, it is needless to mention that a charging prevention film is not limited to this, and conductive polymer may be applied to the insulating film 1106 to form a charge prevention film. The insulating film 1106 was pasted to the faceplate 1006 by applying a transparent pressure sensitive adhesive to the insulating film 1106. However, it is needless to mention that the pasting of the insulating film 1106 and the faceplate 1006 is not limited to this method, and for example, a transparent adhesive may be used.

In addition, the second potential regulating member 1103 is arranged in a region to which the first potential regulating member 1102 is orthogonally projected on an interface between the faceplate 1006 and the insulating film 1106. The region is regulated to the GND potential. The second potential regulating member 1103 is arranged in the region on the faceplate 1106 to which the first potential regulating member 1102 is orthogonal projected as described above, whereby an electric field in the vicinity of the end on the anode electrode side of the first potential regulating member 1102 can be weakened, and a dielectric voltage between the first potential regulating member 1102 and the anode electrode 1101 can be increased.

The image display device having such a structure can be driven with a high voltage compared with an image display device that does not have the second potential regulating member 1103. More specifically, when the image display device was driven with an anode voltage Va of 10 kV, no break down was observed and a satisfactory image display device could be obtained. Further, when the anode voltage Va was forcibly increased, no break down was observed until the anode voltage Va reached 15 kV.

In addition, a region 1112 to which the anode electrode 1101 is orthogonally projected on the interface between the faceplate 1006 and the insulating film 1106 is regulated to a potential that depends on a ratio of resistance values of the faceplate 1006 and the insulating film 1106.

Here, when the faceplate 1006 is made of soda-lime glass with a thickness of 3 mm and the insulating film 1106 is made of PET as described above, a potential Vb on the interface between the faceplate 1006 and the insulating film 1105 is represented as follows:

$$Vb=Rf\times Va/(Rg+Rf)$$

$$Rg=tg\times\rho g$$

$$Rf=tf\times\rho f$$

Here, a volume resistivity ρg of the faceplate 1006 is $7.0\times10^{14}$ [Ω.cm] and a thickness tg of the faceplate 1006 is 0.3 [cm]. A volume resistivity ρf of the insulating film 1106 is $2.0\times10^{16}$ [Ω.cm] and a thickness tf of the insulating film 1106 is 0.1 [cm]. Note that these values are assumed to be values at a room temperature. Therefore, since Vb substantially equals Va, a voltage is hardly applied to the faceplate 1006 and an electric field is not generated inside the glass. Thus, alkaline ions do not move. Although PET with a thickness of 1 mm was used as the insulating film 1006 in this embodiment, it is needless to mention that the insulating film 1006 is not limited to this. Any material may be used as the insulating film 1006 as long as it is transparent, and the insulating film 1006 may have any thickness as long as it is in the order of 0.1 mm, which is a thickness with which a material is generally regarded as a film, to approximately 5 mm that is a thickness with which parallax is not caused.

As described above, the charging prevention film 1109 was provided on the faceplate 1006 via the insulating film 1106, whereby the outside surface of the image display device was not charged. Therefore, discharge that was unpleasant for an observer and uneasiness to see an image due to adhesion of dusts could be avoided.

Twelfth Embodiment

Figure 17:
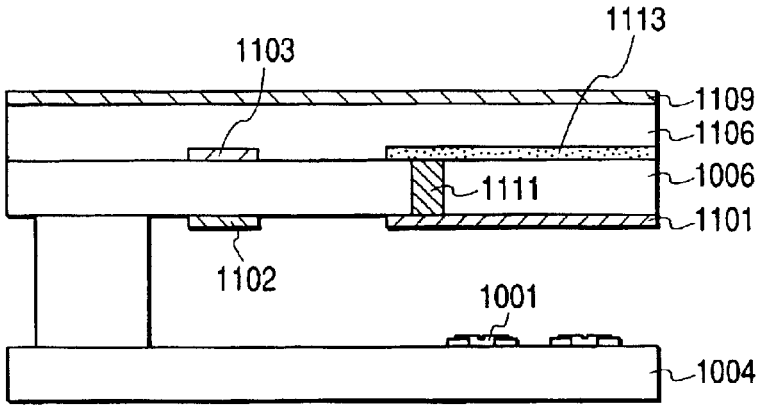
FIG. 17 is a schematic sectional view of an image display device in accordance with a twelfth embodiment of the present invention.

Next, a twelfth embodiment of the present invention will be hereinafter described with reference to FIG. 17.

As in the eleventh embodiment, the faceplate 1006 has the anode electrode 1101 and the first potential regulating member 1102. A metal leaf (copper) tape 1103 was pasted as the second potential regulating member to a region to which the first potential regulating member 1102 was orthogonally projected and was connected to the GND potential. In addition, a transparent electrode 1113 of ITO functioning as a third potential regulating member was also provided in an area to which the anode electrode 1101 was orthogonally projected, and was connected to the anode electrode 1101 via a high voltage terminal 1111. The transparent electrode 1113 was regulated to an anode voltage. In addition, TAC (cellulose triacetate) was used as the insulating film 1106 with a thickness of 1.0 mm. With such a structure, the anode electrode 1101 and an orthogonal projection region thereof could be regulated to the same potential. Thus, since an electric field was not generated inside the faceplate 1006 regardless of a glass material of the faceplate 1006 and a material of the insulating film 1106, alkaline ions did not deposit and an image display device that did not cause deterioration of an image quality could be realized.

Thirteenth Embodiment

Figure 18:
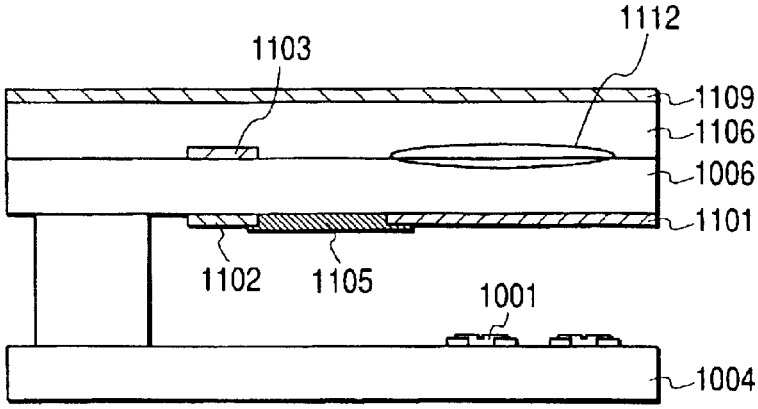
FIG. 18 is a schematic sectional view of an image display device in accordance with a thirteenth embodiment of the present invention.

Next, a thirteenth embodiment of the present invention will be hereinafter described with reference to FIG. 18.

As in the eleventh embodiment, the faceplate 1006 has the anode electrode 1101 and the first potential regulating member 1102. Here, PD200 manufactured by Asahi Glass Co., Ltd. with a thickness of 3 mm was used as a glass substrate of the faceplate 1006. As in the twelfth embodiment, a metal leaf (copper) tape was pasted as the second potential regulating member to a region to which the first potential regulating member 1102 was orthogonally projected, and was connected to the GND potential. In addition, in an area to which the anode electrode 1101 is orthogonally projected, as in the eleventh embodiment, a potential is regulated by a ratio of resistances of a glass material of the faceplate 1006 (Pd200 with a thickness of 3 mm) and a material of the insulating film (in this embodiment, polycarbonate with a thickness of 0.5 mm). Here, as in the eleventh embodiment, a potential Vb of an interface in a region 1112 of the faceplate 1006 and the insulating film 1106 is represented as follows:

$$Vb=Rf\times Va/(Rg+Rf)$$

$$Rg=tg\times\rho g$$

$$Rf=tf\times\rho f$$

Here, a volume resistivity ρg of the faceplate 1006 is $1.0\times10^{15}$ [Ω.cm] and a thickness tg of the faceplate 1006 is 0.3 [cm]. A volume resistivity ρf of the insulating film 1106 is $2.1\times10^{16}$ [Ω.cm] and a thickness tf of the insulating film 1106 is 0.2 [cm]. Therefore, since Vb was approximately 9.3 kV and a voltage applied to the faceplate 1006 was approximately 0.7 kV, alkaline ions did not deposit and an image display device that did not cause deterioration of an image quality could be realized.

In addition, when a creeping surface between the first potential regulating member 1102 and the anode electrode 1101 of the faceplate 1006 (surface of the faceplate substrate) is made of glass (dielectric body), concentration of an electric field in a triple junction occurs or the creeping surface is charged as described before, the faceplate 1006 becomes a cause of break down. Thus, the image display apparatus of this embodiment is provided with a high resistance film 1105 on the glass surface.

In this embodiment, a nitride of germanium and tungsten manufactured by the sputtering method was used as the high resistance film 1105. When a surface resistance value Rs of the high resistance film 1105 in this case was measured, it was $2\times10^{11}$ [Ω/□].

The image display device having such a structure can be driven with a high voltage compared with an image display device that does not have the second potential regulating member 1103. More specifically, when the image display device was driven with an anode voltage Va of 10 kV, no break down was observed and a satisfactory image display device could be obtained. Further, when the anode voltage Va was forcibly increased, no break down was observed until the anode voltage Va reached 18 kV.

As described above, the image display device of the present invention has a second potential regulating member regulated to a potential lower than that of an anode electrode at least in the vicinity of an end of a first potential regulating member on the anode electrode side on a surface on the opposite side of a surface having a first potential regulating member of a faceplate. Thus, an electric field at the end of the first potential regulating member on the anode electrode side can be effectively weakened. Consequently, it becomes possible to increase a dielectric voltage of the image display device while reducing a depth and a frame region of the image display device, and reliability of the image display device can be increased.

What is claimed is:

1. An image display device comprising:

a rear plate having an electron beam source; and a face plate having an anode electrode regulated to an electron accelerating potential and a first potential regulating member, which is arranged apart from said anode electrode and is regulated to a potential lower than that of said anode electrode, on a surface opposed to said rear plate, wherein the image display device further comprises a second potential regulating member that is arranged in a part corresponding to said first potential regulating member side of an end of said anode electrode on said first potential regulating member side and on a surface on the opposite side of a surface having said first potential regulating member of said faceplate and that is regulated to a potential lower than that of said anode electrode.

2. An image display device according to claim 1, wherein said second potential regulating member is arranged in a part corresponding to a region between said first potential regulating member and said anode electrode and on the surface on the opposite side of the surface having said first potential regulating member of said faceplate.

3. An image display device according to claim 1, wherein a resistance value of said first potential regulating member is larger than a resistance value of said anode electrode.

4. An image display device according to claim 3, wherein the resistance value of said first potential regulating member is one-hundred times or more as large as the resistance value of said anode electrode.

5. An image display device according to claim 1, wherein said second potential regulating member is arranged so as to overlap an orthogonal projection of said first potential regulating member.

6. An image display device according to claim 1, wherein said second potential regulating member is arranged so as to overlap at least an orthogonal projection of a part closest to said anode electrode in said first potential regulating member.

7. An image display device according to claim 1, wherein said second potential regulating member is arranged so as to overlap at least an orthogonal projection of a circumferential end of said anode electrode.

8. An image display device according to claim 1, wherein said second potential regulating member is arranged over substantially the entire surface of said faceplate.

9. An image display device according to claim 8, wherein said second potential regulating member is formed of a transparent material.

10. An image display device according to claim 1, wherein a high resistance film is formed in a region between said first potential regulating member and said anode electrode on said faceplate.

11. An image display device according to claim 10, wherein a surface resistance value of said high resistance film is $1\times10^{7}$ [Ω/□] or more.

12. An image display device according to claim 10, wherein a surface resistance value of said high resistance film is $1\times10^{16}$ [Ω/□] or less.

13. An image display device according to claim 1, wherein said first potential regulating member is arranged so as to surround the entire circumference of said anode electrode.

14. An image display device according to claim 1, wherein said first potential regulating member is regulated to a ground potential.

15. An image display device according to claim 1, wherein said second potential regulating member is regulated to a ground potential.

16. An image display device according to claim 1, further comprising a charging prevention film that is provided via an insulating layer in a part corresponding to a region where said anode electrode is formed on the surface on the opposite side of the surface having the first potential regulating member of said faceplate, wherein, when it is assumed that a thickness of said faceplate is tg, a volume resistivity of said faceplate is ρg, a thickness of said insulating layer is tf and a volume resistivity of said insulating layer is ρf, $tg\times\rho g<0.1\times tf\times\rho f$ is satisfied.

17. An image display device according to claim 1, further comprising a third potential regulating member regulated to a potential equivalent to that of said anode electrode in a part corresponding to a region where said anode electrode is formed on the surface on the opposite side of the surface having said first potential regulating member of said faceplate.

18. An image display device according to claim 17, wherein a charging prevention film is provided via an insulating layer on a surface on the opposite side of a surface opposed to said faceplate of said third potential regulating member.

19. An image display device according to claim 1, wherein said electron beam source is a surface conduction electron-emitting device.

* * * * *